United States Patent [19]

Dallman

[11] 4,392,629

[45] Jul. 12, 1983

[54] MOUNTING SYSTEM

[76] Inventor: Brian L. Dallman, P.O. Box 248, Second & Elm, Hudson, Wis. 54016

[21] Appl. No.: 287,290

[22] Filed: Jul. 27, 1981

[51] Int. Cl.[3] ..... A47B 96/06

[52] U.S. Cl. ..... 248/205 R; 108/152

[58] Field of Search ..... 248/205 R, 236, 238, 248/214, 215, 441 B, 441 C, 213.4, 225.2, 235; 108/47, 97, 152; 211/86, 87

[56] References Cited

U.S. PATENT DOCUMENTS

| | | | |
|---|---|---|---|
| 1,369,884 | 3/1921 | Church | 108/152 |
| 1,443,339 | 1/1923 | Barrett | 108/152 |
| 2,558,323 | 6/1951 | Strun | 108/149 |
| 3,068,048 | 12/1962 | Mahon et al. | 108/152 |
| 3,669,035 | 6/1972 | Grossman | 108/152 |

FOREIGN PATENT DOCUMENTS

| | | | |
|---|---|---|---|
| 2404411 | 6/1979 | France | 248/225.2 |

*Primary Examiner*—William H. Schultz
*Assistant Examiner*—Ramón O. Ramírez
*Attorney, Agent, or Firm*—Mark W. Gehan

[57] ABSTRACT

A novel mounting system is provided comprising a support rack and a rack fastener. The mounting system is especially useful for mounting refrigeration units onto foamed-in-place wall panels.

5 Claims, 3 Drawing Figures

MOUNTING SYSTEM

FIELD OF THE INVENTION

This invention relates to mounting systems. More particularly this invention relates to mounting systems for use with foamed-in-place structures.

BACKGROUND OF THE INVENTION

Recently it has become economically advantageous to construct large walk-in coolers using foamed-in-place panels comprising sheet metal skins between which foam insulation is formed in situ.

Despite the many advantages that foamed-in-place walk-in coolers have over conventional wood framed, fiberglass insulated coolers, one inherent limitation in the foamed panels is their lack of internal strength with respect to vertically applied load. Such is the case when it is desired to mount a refrigeration condensing unit on a foamed wall panel.

Various methods are being employed by manufacturers to accomplish the wall mounting of a condensing unit, the most common method being the "straddle" approach. In this approach the condensing unit is located in a suitable mounting rack with a housing and is attached to horizontal members (angles or channels) which rest in notches disposed in the upper end of the wall sections and extend into the interior of the walk-in cooler. On the extension of these members is mounted a unit cooler. Inter-connecting tubing and wiring must be routed in close proximity to the horizontal members. The points at which the horizontal members bear on the wall panel become the points to which is transmitted the total weight of the refrigeration system. The usual result is crushing of the foamed panel at the bearing point of the horizontal members on the top of the panel. Failure of sheet metal adhesion to the foam, and/or foam fracture, are also typical at the bearing point of the horizontal members on the panel.

SUMMARY OF THE INVENTION

In accordance with the present invention there is provided a mounting system which is especially useful for mounting a refrigeration condensing unit on the wall of a foamed-in-place panel, e.g. of a walk-in cooler. The mounting system comprises:

(a) a support rack having upright members and a horizontal shelf supported thereby, wherein at least one hook member is attached to the upper portion of said upright members, and (b) a rack fastener which is adapted to be fastened to the top of a support surface (e.g. the top of a cooler), wherein said rack fastener includes a horizontally disposed member which is adapted to engage and support said hook member of said support rack.

BRIEF DESCRIPTION OF THE DRAWINGS

The present invention is described in more detail hereinafter with reference to the accompanying drawings wherein the reference characters refer to the same parts throughout the several views and in which.

DETAILED DESCRIPTION OF THE INVENTION

Figure 1:
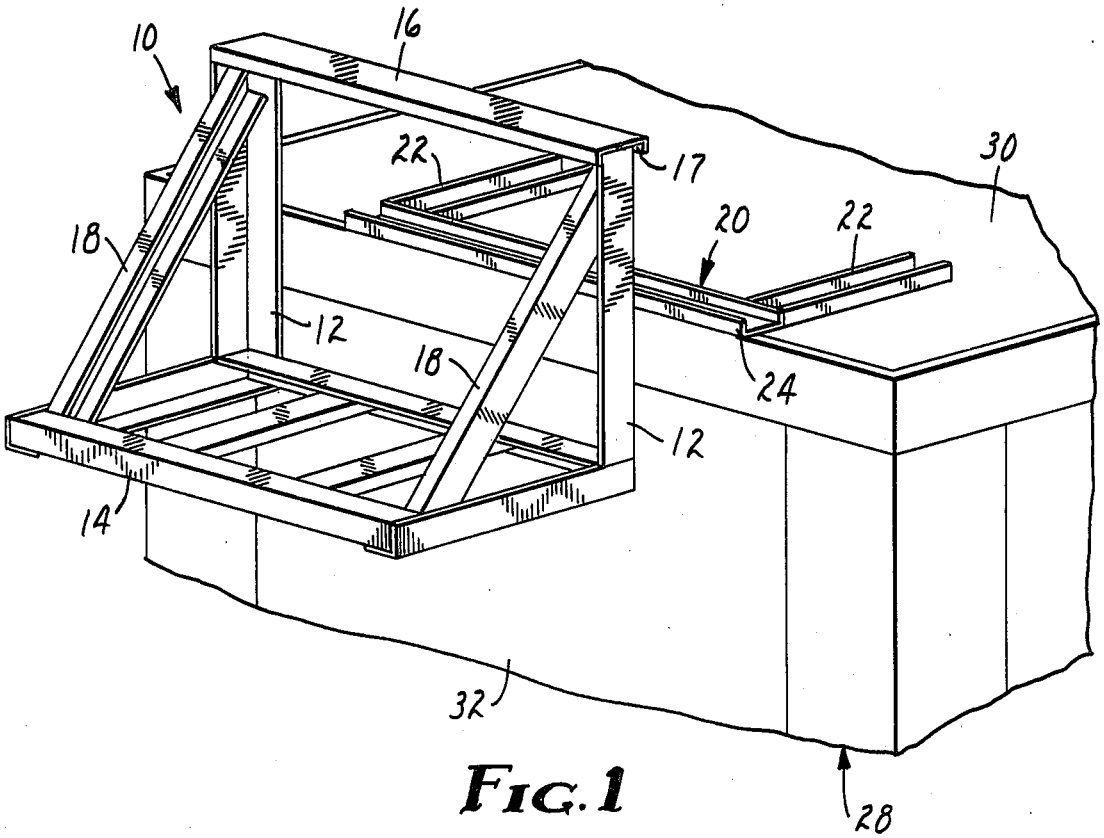
FIG. 1 is a perspective view of the mounting system of the invention.

In the accompanying drawings there is shown a mounting system comprising support rack 10 and rack fastener 20. Support rack 10 includes upright members 12, horizontal shelf 14 fastened to and supported by upright members 12, and horizontally extending hook member 16 which is attached to the upper portion of upright members 12. Braces 18 may also be included to provide additional support. Hook member 16 includes downwardly projecting lip 17.

Figure 3:
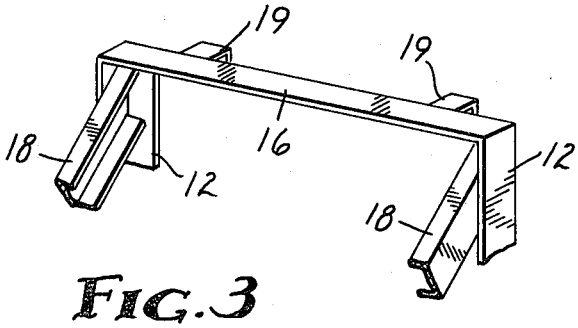
FIG. 3 shows an alternate embodiment of the support rack used in the present invention.

Preferably, support rack 10 is made of channel iron components which are welded together, although formed sheet metal may also be suitable. It is also preferable for the hook member 16 to be an integral part of the rack and to span the full width of the rack. Alternatively, horizontal member 16 may have two or more separate hook members 19 connected thereto, as shown in FIG. 3.

The rack fastener 20 is adapted to be fastened to the top of a support surface 30 of walk-in cooler 28 by means of nylon bolts (or other thermally non-conductive means) through arms 22. Rack fastener 20 also includes upwardly projecting lip member 24 which is horizontally disposed along the top surface of cooler 28 and which is adapted to engage and support hook member 16 of the support rack 10. Preferably, rack fastener 20 is also constructed of channel iron components welded together. It is also preferable for lip member 24 to span the full width of rack 10, although it is possible for such lip member to be discontinuous so that separate lip members are disposed along the width of rack fastener 20.

Figure 2:
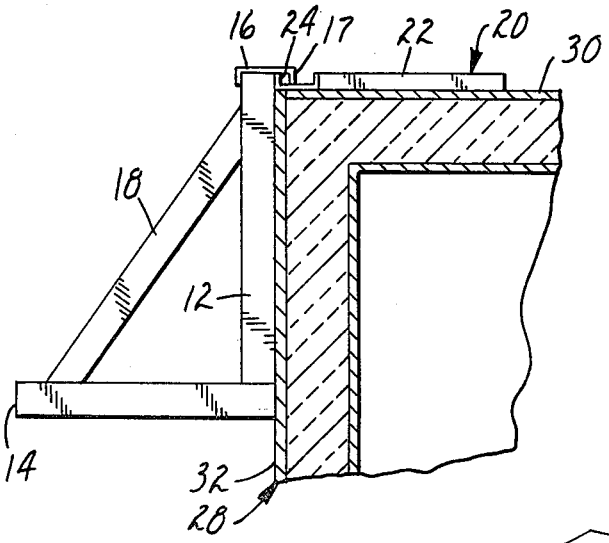
FIG. 2 is a side view of the mounting system of the invention.

After the support rack 10 has been mounted on, and engaged with, the rack fastener 20 (as shown in FIG. 2), the support rack 10 may also be securely fastened to the wall 32 of cooler 28 by means of nylon bolts (or other thermally nonconductive means) to prevent the rack 10 from being inadvertently disengaged from the rack fastener 20.

With the use of the mounting system of the invention the weight of the support rack (and any item contained thereon) is distributed over a large area of the wall panel. The mounting system of the invention is very useful, for example, for mounting a refrigeration condensing unit on a walk-in cooler having foamed-in-place panels for walls. In such case the condensing unit is placed on the horizontal shelf 14 and covered by a suitable housing. The condensing unit is then operatively connected to an individually mounted cooler unit by means of an electrical wiring harness and tubing equipped with self-sealing refrigerant couplings. Such an arrangement permits all of the refrigerant-containing components to be pre-charged and leak-tested at the factory, with inter-connection accomplished at the time of installation.

The mounting system of the present invention dramatically increases the load bearing capability of a foamed-in-place wall panel. Testing of a conventional "straddle" mounting system with a condensing unit weighing 580 pounds produced failure of a foamed-in-place panel at the bearing points. On the other hand, utilizing the mounting system of this invention, there was no panel failure until a loading of 1800 pounds was reached.

Other variants are permissible without departing from the scope of the present invention.

What is claimed is:

1. A mounting system comprising:

(a) a support rack having upright members and a horizontal shelf supported thereby, wherein a hook member is attached to the upper portion of said upright members, and (b) a rack fastener which is adapted to be fastened to a support surface, wherein said rack fastener includes a horizontally disposed member which is adapted to engage and support said hook member of said support rack, wherein said horizontally disposed member spans substantially the full width of said support rack.

2. A mounting system in accordance with claim 1, wherein said hook member spans substantially the full width of said support rack.

3. A mounting system in accordance with claim 1, wherein said hook member comprises channel iron.

4. A mounting system in accordance with claim 1, wherein there are at least two of said hook members attached to the upper portion of said upright members.

5. A mounting system in accordance with claim 1, wherein said horizontally disposed member of said rack fastener comprises channel iron.

* * * * *